US008365955B2

(12) United States Patent
Bosshardt

(10) Patent No.: US 8,365,955 B2
(45) Date of Patent: Feb. 5, 2013

(54) LIGHTWEIGHT HINGED-LID CLOSURE FOR A FLEXIBLE TUBE

(75) Inventor: Michel Bosshardt, Sainte-Menehould (FR)

(73) Assignee: Cebal SAS, Genevilliers (FR)

( * ) Notice: Subject to any disclaimer, the term of this patent is extended or adjusted under 35 U.S.C. 154(b) by 270 days.

(21) Appl. No.: 11/571,291

(22) PCT Filed: Jul. 4, 2005

(86) PCT No.: PCT/FR2005/001708

§ 371 (c)(1),
(2), (4) Date: Dec. 26, 2006

(87) PCT Pub. No.: WO2006/013276

PCT Pub. Date: Feb. 9, 2006

(65) Prior Publication Data

US 2007/0210103 A1 Sep. 13, 2007

(30) Foreign Application Priority Data

Jul. 6, 2004 (FR) ..... 04 07471

(51) Int. Cl.
*B65D 35/00* (2006.01)

(52) U.S. Cl. ..... 222/106; 222/107; 222/546; 222/556; 220/254.3; 220/839; 215/235

(58) Field of Classification Search ..... 222/106, 222/546, 556, 107; 220/254.3, 780, 839; 215/235–237

See application file for complete search history.

(56) References Cited

U.S. PATENT DOCUMENTS

| | | | | |
|---|---|---|---|---|
| 4,782,964 | A * | 11/1988 | Poore et al. | 215/253 |
| 5,547,091 | A * | 8/1996 | Neveras et al. | 215/237 |
| 5,782,388 | A * | 7/1998 | De Nervo | 222/546 |
| 5,950,848 | A * | 9/1999 | Baudin | 222/556 |
| 6,631,833 | B2 * | 10/2003 | Harriman et al. | 222/536 |
| 6,848,603 | B2 * | 2/2005 | Gaiser et al. | 222/153.1 |
| 7,128,227 | B2 * | 10/2006 | Skillin et al. | 222/556 |
| 7,255,250 | B2 * | 8/2007 | Pugne | 222/556 |
| 7,404,495 | B2 * | 7/2008 | Keung | 215/237 |
| 2006/0137999 | A1 | 6/2006 | Williams | |

FOREIGN PATENT DOCUMENTS

GB 2337035 A 11/1999

* cited by examiner

*Primary Examiner* — Frederick C. Nicolas
(74) *Attorney, Agent, or Firm* — Ladas & Parry LLP

(57) ABSTRACT

A hinged-lid closure equipped with a lid and a base including a plate, an attachment skirt and an external lateral skirt, where the attachment skirt is thicker than the plate and the external lateral skirt. The base is equipped with a radial longitudinal rib attached to an internal surface of the external lateral skirt and located in a plane mid-perpendicular to the hinge.

15 Claims, 3 Drawing Sheets

LIGHTWEIGHT HINGED-LID CLOSURE FOR A FLEXIBLE TUBE

FIELD OF THE INVENTION

This invention relates to flexible plastic tubes intended for storing and dispensing liquid to pasty products. It relates more specifically to high-capacity plastic tubes typically having a capacity greater than or equal to 150 ml.

DESCRIPTION OF RELATED ART

Under the European Directive 94.62 relating to the reduction of the weight of packages, industries are seeking to reduce the amount of plastic material consumed and recycled.

To apply the provisions of this Directive to flexible tubes, a first approach consists of reducing the thickness of their walls. Such a solution was adopted without any problem for low-capacity tubes, having a flexible skirt of small diameter. However, a simple reduction in the thickness of the skirt or the shoulder finds its limits in the mechanical strength of the tube, in particular for tubes with a capacity greater than 150 ml of which the large majority have diameters greater than 40 mm, and more specifically, the problems of mechanical strength increase with the diameter, for tubes having a skirt diameter greater than 45 mm. With such geometries, the rigidity of the skirt becomes inadequate and makes it difficult to manipulate both during production of the tube and when filling and using it. For practical reasons, flexible tubes typically have a capacity of less than 400 to 500 ml, with a diameter of less than 60 mm, because above these sizes, they become unmanageable and are replaced by rigid flasks.

In general, a flexible tube is produced by assembling two parts produced separately; a cylindrical flexible skirt with a given length (typically 3 to 5 times the diameter) and a head including a neck equipped with a dispensing mouth and a shoulder connecting said neck to the cylindrical skirt. The plastic head can be moulded separately, then welded to one end of the skirt, but it is advantageously moulded and welded autogenously to the skirt using either an injection moulding technique (FR 1 069 414) or an extruded blank compression moulding technique (FR 1 324 471). Depending on the use of the tube, the cylindrical skirt can be obtained industrially in two different ways. For tubes intended for storing and dispensing cosmetic products, it is generally obtained by direct extrusion or co-extrusion of a plurality of plastic materials, in the form of a hollow cylindrical extrudate. The tube having such a skirt is in this case called a "plastic tube". For tubes intended for storing and dispensing mass market products at a low cost, a plastic strip is generally used, which is shaped into a cylindrical form by creating a correspondence (contact or overlapping) between its two longitudinal edges (see for example U.S. Pat. No. 1,007,779), then longitudinal welding along these edges. The tube having such a skirt—which is often made of a multilayer plastic material with a barrier layer—is in this case called a "laminate tube".

After assembly of the skirt and the head, the tube is sent to the packager, with the head at the bottom and the dispensing aperture closed—for example by a cap screwed onto the neck—so that the packager can fill the tube by the open end of the tube. To facilitate the shipping to the packager, the tubes are placed vertically, grouped and stacked. The stacks are piled on one another, thus forming a large number of layers of which the thickness corresponds to the axial length of the tube, which typically results in stacks of some 15 layers for a truck shipment. Once it arrives at the packager, the tube is filled, its open end is flattened so as to perform a welding operation that, by joining the wall portions opposite one another after the flattening, seals the product thus packed (so-called transverse or final weld).

Another method for producing a flexible tube is, for example, described in U.S. Pat. No. 5,632,951; by extrusion blow moulding, a thin-walled flask is produced and the base of the flask is cut so as to obtain an object very similar to the flexible tubes described above, but differing therefrom by the presence of weld lines that extend over the entirety of the external surface, including the head.

For high-capacity tubes, of which the diameter of the skirt is typically between 40 mm and 60 mm, the thickness of the skirt of the prior art is systematically greater than 0.5 mm, whether it is (co)extruded, laminated or obtained by extrusion blow moulding. Indeed, regardless of the mode of production of the skirt, it must undergo a large number of manipulations until the filled tube has been sealed by the final weld. These manipulations are necessary, on the one hand, to perform transfers between different production stations and, on the other hand, to ensure adequate mechanical support during the production or shaping operations (assembly of the head and skirt, printing on the skirt, capping, etc.). When arriving at a production or shaping station, the tube is moved by a support device mounted on a transfer chain (for example a pin, a platform or a mandrel) toward a mandrel on which it is fitted for most of the time without clearance and even with a slight clamping. Once the operation has been completed, it is removed from the mandrel and directed toward a new support device associated with another transfer chain in order to take it to another production station.

The flexible tubes that have large-diameter skirts are not sufficiently rigid if the thickness of said skirts is less than 0.5 mm. They are exposed, particularly at their open end, to a high risk of folding either during the fitting on the mandrel or during the removal from the mandrel. To limit this risk, it is possible to increase the clearance between the skirt and the mandrel, but this would result in reduced support of the skirt during the production or shaping operation and could result in inadequate quality: lower precision of the positioning of the head on the skirt capable of causing a welding defect between the head and skirt, poor placement of the skirt on the mandrel causing printing defects (offset printing or flexography on cylindrical wall of tubular body), and so on.

Moreover, when they are transported to the packager, the stacked tubes located in the lower layers must support the weight of the stacks piled above them, and they are often damaged at the open end of their skirt if it does not have the appropriate rigidity.

Finally, even undamaged, the open ends of the tubes have a shape that is less consistent when the thickness is low (greater influence of residual stresses on the shape of the free end of the skirt), which causes problems in the automatic filling of the tube.

As all of these problems are exacerbated by the large quantities and high speeds of production of this type of packaging, it has been established that, in practice, such tubes must have a thickness greater than around 0.5 mm in order to have acceptable machinability and transportability.

The attempts to reduce the weight of the flexible tubes by substantially reducing the thickness of the tube therefore have not heretofore resulted in an economically profitable industrial operation. Other attempts at reducing the weight have been made by the applicant, based on a technique developed for flasks. The flasks are made in a single piece by extrusion blow moulding; a thick tube is extruded, which is crimped at a distance from the die (obtaining a parison), then the inside of the parison is blown up by sending low pressure air through the line of the die, the parison wall being thinned and coming into contact with the walls of a mould that gives the flask its final shape. For this type of packaging, the U.S. Pat. No. 6,082,563 (WELLA) describes a production method in which the plastic material constituting the wall of the parison is partially modified by adding blowing agents. The blowing agents are added to an intermediate layer during the co-extrusion process. The thickness of the layer exposed is, after extrusion and before blowing, equal to or greater than 3 mm. After blowing, it is on the order of 500 μm, i.e. close to the thickness of a flexible tube skirt.

In fact, the reduction in the weight by producing an expanded layer using a blowing agent is possible only in this case because a thick parison of at least 3 mm is extruded. For conventional high-speed mass production of flexible tubes, the skirt of the tube must be obtained directly by extrusion with a thickness at least six times lower, under conditions so that it is difficult or even impossible, to control the action of the blowing agent in the screw, then in the convergent zone of the extruder, so that a skirt is obtained with an expanded extruded layer with significant irregularities in thickness, which does not make it possible to provide an acceptable industrial packaging. Finally, the addition of blowing agents carries an additional cost.

PROBLEM TO BE SOLVED

The applicant has sought to obtain a high-capacity flexible tube that is as lightweight as possible, that has a cylindrical skirt that is as strong and rigid as that of standard tubes, while being comfortable for the user to hold as well as having a resistance to cracking under stress comparable to that of standard tubes.

The objective is to significantly reduce (at least 30%) the weight of the tubes while preserving an acceptable mechanical behaviour compatible with the production requirements and with its use by the consumer. In addition, insofar as these tubes are essentially intended for the cosmetic product market, they must also be compatible with equivalent products, in particular ensuring low liquid permeability (for water, alcohols, oils and other fatty substances, etc.), and this low liquid permeability must involve limited weight losses. It is also desirable for them to have an acceptable permeability to steam and odours.

SUMMARY OF THE INVENTION

A first object of the invention is a method for producing a flexible tube comprising a cylindrical skirt and a dispensing head (i.e. equipped with a dispensing aperture), comprising at least the following steps:

a) extrusion of a cylindrical sleeve;

b) cutting of the sleeve so as to produce a tube skirt with the desired length;

c) moulding of the head of the flexible tube;

d) attachment of the head to one end of the skirt; characterised in that the extruded sleeve has a thickness of between 0.2 and 0.4 mm, preferably between 0.25 mm and 0.35 mm and in that it includes high-density polyethylene (HDPE), with a specific weight between 0.935 g/cm3 and 0.97 g/cm3, preferably greater than 0.945 g/cm3 in a weight proportion greater than 55%, and preferably 70%. Advantageously, the sleeve also includes low-density polyethylene (LDPE), with a specific weight between 0.86 g/cm3 and 0.93 g/cm3, in a weight proportion below 45% and preferably 30%, and of which more than 50% and preferably more than 90% by weight is a linear LDPE (LLDPE).

This method includes the conventional steps of producing a plastic tube of which the skirt is created by cutting an extruded sleeve, but said sleeve is particularly thin and comprises a plastic material different from that of the plastic tubes of the prior art. The sleeve is obtained by extrusion of a HDPE+LDPE mixture (more than half being LLDPE; or by co-extrusion of a plurality of coaxial HDPE or LDPE layers (more than half being LLDPE), or layers of HDPE+LDPE mixtures. For a given thickness, between 0.2 and 0.4 mm, the plastic tubes thus produced have the best characteristics (with regard to all of the constraints of production and use) when the sleeve was produced with more than 90% by weight HDPE and less than 10% by weight LLDPE.

The advantage of such a method is observed in particular for plastic tubes with a large diameter, starting at 34 mm and in particular larger than 44 mm, because these, which are much lighter in weight than standard tubes of the same capacity, have a rigid cylindrical skirt that provides a good compromise between the constraints of mass production and the constraints of consumer use. The good cracking resistance under stress is ensured by the high proportion of HDPE and LLDPE. Laminate tubes, with a diameter greater than 44 mm, also have these advantageous properties.

Another object of the invention is a flexible tube having a dispensing head and a cylindrical skirt made of a plastic or metalloplastic material, with a diameter greater than 44 mm, and more specifically greater than 49 mm, characterised in that said cylindrical skirt has a thickness of between 0.2 mm and 0.4 mm, and preferably between 0.25 mm and 0.35 mm, in that it includes high-density polyethylene (HDPE) with a specific weight of between 0.935 g/cm3 and 0.97 g/cm, preferably greater than 0.945 g/cm3 in a weight proportion greater than 55%, and preferably 70%. Advantageously, the sleeve also includes low-density polyethylene (LDPE), with a specific weight between 0.86 g/cm3 and 0.93 g/cm3, in a weight proportion below 45% and preferably 30%, and of which more than 50% and preferably more than 90% by weight is a linear LDPE (LLDPE).

The tube according to the invention is a plastic tube or a laminate tube having a head equipped with a dispensing aperture and a cylindrical skirt of large diameter, typically greater than 44 mm. The head generally includes a neck that surrounds the dispensing aperture and a shoulder that connects the neck to the skirt. The skirt is cylindrical, but its cross-section is not necessarily circular. In fact, the tube is described here in its filling configuration, before producing the final transverse weld that seals the packaged product. The skirt can have a circular or elliptical orthogonal cross-section, or one of any other shape (imposed by the periphery of the shoulder, which is attached to the end of the skirt) but, during production of the tube, it is generally fitted onto a cylindrical sleeve with a circular cross-section, and this is why we refer here to a diameter. It goes without saying that for a skirt with a non-circular cross-section, it is its perimeter that must be greater than $\pi 44$, i.e. around 138 mm. For an elliptical skirt, if a is half the large axis and b is half the small axis, $\sqrt{2(a^2+b^2)}$ is greater than 44 mm.

Traditionally, flexible tubes have had skirts consisting primarily, or entirely, of LDPE. A tube according to the invention having the same diameter as a traditional tube has a thinner skirt but composed primarily, or entirely, of HDPE. If the HDPE is not used alone, the skirt can be made of a single material, for example a blend resulting from a mixture according to the invention of HDPE and LDPE, of which the majority is a linear LDPE. The presence of LLDPE and the percentage of HDPE in such a blend can be determined, for example, by using two complementary techniques: Fourier transform infrared spectrometry (FTIR), using, for example, a Nicolet FTIR 510P spectrometer and differential scanning calorimetry, for example, using a complete Perkin Elmer DSC 7 analysis system, said method itself being capable of being either implemented conventionally (temperature increase—decrease—increase cycle), or, when necessary, according to the SIST method (Stepwise Isothermal Segregation Technique).

The skirt, laminated or co-extruded, can also be made of a multilayer material including layers of HDPE, layers of LDPE, of which the majority is a linear LDPE, and/or layers of HDPE+LDPE mixtures.

The applicant has observed that, when made of a more rigid material, the skirt can have, owing to its lower thickness, a radial driving resistance that is identical, and even inferior, to that of a skirt of the prior art, while having, in spite of this lower thickness, an equal or greater resistance to buckling and folding under the effect of the same compressive axial stress. In other words, by combining the thickness and the type of constitutive material, it is possible to satisfy the contradictory requirements of machinability, flexibility and comfort of use, which LDPE was heretofore considered to be the only material capable of satisfying, but on the condition of having the form of a sufficiently thick layer.

Contrary to appearances, the use of a more rigid material than LDPE to compensate for the loss in rigidity due to the thinning is not necessarily required. Indeed, it is known from experience that the use of more rigid materials results in a loss in ergonomics of use. Indeed, it is not as easy to grip the tube, as the tube is no longer relatively flexible (the product is more difficult to extract by simply applying pressure on the wall of the skirt) or has an excessively resilient behaviour: the product is barely extracted from the aperture, is reabsorbed inside the tube as soon as the pressure on the skirt is reduced. In addition, it is desirable to prevent the tube from easily returning to its initial shape because, in such a case, the user cannot determine the amount of product that remains. Such a property is illustrated by the extent of the resilient return of the material after plastic deformation by folding: the greater this return is, the more "shape memory" the material has and the poorer the ergonomics of use are. This shape memory is often characterised by the angle obtained after folding and resilient return of a strip of constant thickness: the greater the angle is, the more shape memory the material has; conversely, the smaller the angle is, the better its aptitude is to keep the new shape, which is referred to as a "dead fold". Metallic tubes have a very good dead fold property, while plastic tubes generally have a poor or mediocre dead fold property. In this case, the applicant has observed that, owing to the notable reduction in the thickness of its wall, the tube has a better dead fold property, i.e. better ergonomics of use in spite of the use of a material (HDPE) that is more rigid than LDPE.

If the skirt is made of a multilayer material, external layers are preferably made of HDPE: the result is a slightly better axial buckling resistance. Moreover, external layers made of HDPE are less sensitive to cracking under stress.

In addition, HDPE has a liquid permeability that is clearly lower than that of LDPE, in a ratio such that the reduction in thickness does not cause a deterioration in the liquid barrier properties (water, alcohols, oils and other fatty substances that might be contained in the cosmetic product to be packaged), which maintains the performances in terms of acceptable weight loss. A slight improvement is also observed in the gas and odour diffusion barrier properties.

According to the invention, the LDPE, if it exists in the skirt, is a minority component thereof, limited to 30% by weight, and preferably 10%. It is primarily constituted by linear LDPE (or LLDPE), i.e. a copolymer polyethylene comprising non-polar alpha olefins (such as butene-1 or hexene-1) of which the molecules have only short and regular lateral chains. The addition of linear LDPE is recommended to improve both the weldability of the skirt and the resistance to cracking under stress.

Stress cracking is a property associated with long-term behaviour: when the material under stress is immersed into a surfactant liquid, a crack will appear after a certain time. This phenomenon, which is very important in the case of polyethylene, is highly dependent on the superficial tension exerted by the medium, the molar weight and the morphology of the polymer. It is known that the crack occurs sooner when the stress is higher and the material (polyethylene in this case) has a high melt index.

Linear LDPE (LLDPE) has a weight proportion greater than 50%. This proportion is preferably higher as the LDPE proportion is greater in the material of the skirt. This makes it possible to enhance the skirt's weldability and resistance to cracking under stress. Thus, for a mixture of 70% HDPE+30% LDPE, the latter should preferably be more than 90% by weight LLDPE.

For a given thickness, between 0.2 and 0.4 mm, plastic and laminate tubes provide the best characteristics with regard to all constraints of production and use when the skirt comprises more than 90% by weight HDPE and less than 10% LLDPE.

Preferably, the flexible tube also has a lightweight dispensing head on which a cap or a dispensing tip is to be attached, such as a hinged-lid closure. In general, the head of the tube includes a neck surrounding the dispensing aperture and a shoulder connecting said neck to the skirt, and it is on said neck that said cap or hinged-lid closure is attached. In the context of the invention, a neck equipped with securing means, such as a snap-on bead, is preferred to a neck equipped with a screw thread, which is more sensitive to cracking under stress. It is thus possible to limit the thickness of the neck and the shoulder to a value typically below 1 mm. Said head is preferably made of a material that includes high-density polyethylene (HDPE), with a specific weight between 0.935 g/cm3 and 0.97 g/cm3, preferably greater than 0.945 g/cm3 in a weight proportion greater than 55%, and preferably 70%. Advantageously, the head also includes low-density polyethylene (LDPE), with a specific weight between 0.86 g/cm3 and 0.93 g/cm3, in a weight proportion below 45% and preferably 30%, and of which more than 50% and preferably more than 90% by weight is a linear LDPE (LLDPE).

According to this modality of the invention, the tube has a head composed primarily, or entirely, of HDPE. If the HDPE is not used alone, the head can be made of a single material, for example a blend resulting from a mixture according to the invention of HDPE and LDPE, of which the majority is a linear LDPE. The head can also have a multilayer wall with layers made of HDPE and/or LDPE, of which the majority is a linear LDPE, and/or made of mixtures of HDPE+LDPE. The head can be moulded separately, then welded to one end of the skirt, but it can also be moulded and welded autogenously to the skirt. This multilayer head can be obtained either by co-injection according to a method as described in EP 1 123 241, or by compression moulding of a co-extruded blank.

The best results (weldability, comfort of use, weight loss, and so on) are obtained when the head has been produced with more than 90% by weight of HDPE and less than 10% by weight of LLDPE.

In this way, the head can have a neck and a shoulder with a thickness of less than 1 mm. Such a tube represents a substantial weight economy: while a standard tube typically weighs between 0.80 and 1.10 g per centilitre of effective volume, a tube according to the invention with the same capacity weighs between 0.55 and 0.80 g per cl of effective volume. We thus obtain, only with the flexible tube, an improvement in packaging weight on the order of 30%. This improvement can be further enhanced if the cap is also subjected to the weight reduction procedure.

Another object of the invention is a tube, such as a flexible tube described above, also equipped with a cap. This cap can be a lightweight hinged-lid closure so that the tube+hinged-lid closure assembly has a weight of between 0.80 and 1.10 g/cl of effective volume of product to be dispensed, compared with a value of between 1.20 and 1.80 g/cl for the dispensing tubes of the prior art. Thus, with the invention, the new tube equipped with its new hinged-lid closure has a weight that is almost identical to that of the tube alone of the prior art; the improvement is thus a weight reduction equivalent to the weight of the hinged-lid closure!

To achieve such a weight improvement, the hinged-lid closure was itself designed in a specific manner, with a thickness and a height as low as possible. The hinged-lid closure has an overall structure identical to that of the hinged-lid closures of the prior art, which include a base intended to be irreversibly attached to the head of the tube and a lid pivoting about a hinge located at the periphery of the base and the lid, the lid closing an aperture formed on the base and in communication with the dispensing aperture of the tube head. The base includes a plate, equipped with said aperture, an attachment skirt and an external lateral skirt, generally cylindrical and configured so that it is approximately in the extension of the skirt of the tube, when the hinged-lid closure is attached to said tube. In such a configuration, the open end of said lateral external skirt more or less engages the peripheral edge of the shoulder. The attachment skirt is an internal cylindrical skirt, equipped, for example, with a snap-on bead. It is intended to be fitted around the neck of the tube. The hinged-lid closure according to the prior art has a thick and rigid base, in particular so as to have a clear opening, the lid pivoting about a stationary axis associated with the tube. The rigidity of the base also made it possible to rapidly strip the hinged-lid closure from the mould using the conventional positioning of the extractor assisting the stripping of the hinged-lid closure; the latter comes into contact with the open end of the external lateral skirt. The rigidity was ensured, on the one hand, by the thickness of the walls of the base and, on the other hand, by the presence of radial ribs, at least 6, typically 8, attached to the internal surface of the external lateral skirt and to the internal surface of the plate. These prevented in particular the external lateral skirt from being deformed, or even from turning inside out like a sock, when the extractor was activated to strip the entire hinged-lid closure from the mould.

In the spirit of the invention, the hinged-lid closure was designed to reduce the weight, to reduce the cooling time after moulding and to facilitate the stripping process. This is the reason for reducing the thickness of the wall of the plate, that of the external lateral skirt and that of the lid, in particular at the level of the upper portion of the grip. In addition, all of the radial ribs were removed, while defining a specific stripping protocol, different from that used in the prior art: the extractor is positioned differently and comes into contact with the open end of the attachment skirt that has not been thinned. The hinged-lid closure according to the invention thus has at least one, and preferably all, of the following geometric features:

- the internal surface of the base is free of any rigidifying radial rib; it contains at most one longitudinal rib used for the angular orientation of the hinged-lid closure with respect to the ornament of the skirt of the flexible tube (index);
- the attachment skirt is relatively thicker than the rest of the hinged-lid closure: by applying, in the stripping process, the extractor at the open end of said attachment skirt, it is possible to easily strip the entire closure, in spite of its thinned portions, and even though it is not supported by radial ribs; thus, the attachment skirt is thicker, typically by a few millimetre tenths, than the rest of the hinged-lid closure, in particular the plate and the external lateral skirt;
- the lid has, on its internal surface, a back draft wall at the level of the upper portion of the grip; in the prior art, a vertical wall was defined in this place, which had the advantage of facilitating the stripping process and the disadvantage of significantly increasing the thickness and therefore the weight of the lid. Indeed, plumb over the upper portion of the grip, the wall has an overhanging slope, and if a constant thickness is to be preserved, this overhanging slope portion corresponds to a back draft portion that is difficult to strip if a standard instrument is used, i.e. in the absence of a sliding drawer-type or mounting plate-type instrument. The applicant has found that it is possible nevertheless to produce a back draft with a slope of less than 35° without having any particular difficulty in the stripping process with a standard mould, but using an extractor acting on the centre of the lid. Thus moulded, the lid has, opposite the upper portion of the grip, an inclined portion with an angle smaller than 35°—with respect to the axis of the closure—toward the inside of the base of the closure.

In addition, the geometry of the external lateral skirt, in particular its height, is preferably defined so that, when the hinged-lid closure is attached to the head of the tube, the open end of said external lateral skirt is at a distance d, as small as possible, from the shoulder of the tube, typically an average distance of between 0.1 and 0.7 mm, and preferably between 0.2 and 0.5 mm. For this, the dimensional tolerance of the production imposed on the tube head and the hinged-lid closure are suitably defined. Thus, if the means for attachment of the hinged-lid closure on the tube head are snap-on beads arranged, on the one hand, on an attachment skirt attached to the plate of the closure and, on the other hand, on the neck of the tube head, the minimum distance L1 between the end of the external lateral skirt and the point of contact on the bead of the attachment skirt is greater than L2−d, L2 being the maximum distance between the point of contact on the bead of the neck and the point of the shoulder located plumb over the axial extension of the external lateral skirt of the hinged-lid closure. In this way, the end of the external lateral skirt of the base of the hinged-lid closure is immediately in local contact with the shoulder when the user handles the tube, and this gives the hinged-lid closure assembly an unexpected and sufficient rigidity in spite of the absence of ribs and the low thickness of the plate. To further enhance the rigidity of the assembly, the shoulder of the tube is advantageously equipped with a path around which the open end of the external lateral skirt fits with as little radial clearance as possible, typically an average radial clearance of less than 0.5 mm, and preferably 0.3 mm.

Furthermore, the hinged-lid closure must generally be indexed, i.e. placed in a precise angular position with respect to an ornament on the tube skirt. The very reliable yet relatively heavy indexing means described in EP-B 0 633 197 can, when possible, be replaced by a simple longitudinal rib attached to the internal surface of the external lateral skirt, which is trapped between two projections of low breadth and low height, located on the shoulder. The attachment of the hinged-lid closure on the tube is performed by a pressing movement, then a rotation. During the pressing, the capsule is immobilized in axial movement, for example, by the complementary snap-on means of the attachment skirt and of the neck described above. Then, during the rotation, the base of the longitudinal rib comes into contact with the highest wall of the first projection which slopes gently in the circumferential direction. In this way, owing to the resilience of the assembly of the closure and the tube head, the longitudinal rib follows this highest wall that, as a cam surface, itself imposes a certain axial translation movement toward the outside of the tube. When it reaches the end of the cam path, the end of the longitudinal rib is no longer in contact, resiliently relaxes and becomes trapped in the space between the two projections. The relief of the second projection is less gradual, so that the latter acts as a stop and prevents the longitudinal rib from continuing its angular movement.

In this case as well, for the sake of reducing the weight of the upper portion of the mandrel, which serves as a mould portion for the tube head, advantageously has two protuberances that act as "cores" for the formation of said projections, so that the latter are produced with a constant thickness and have a cavity toward the inside of the tube.

Finally, the longitudinal rib attached to the internal surface of the external lateral skirt and acting as an index is advantageously located at the mid-perpendicular plane of the hinge: this facilitates the supply of the fine channels defining the different parts of the hinge (tension elements and the hinge itself) and improves the mechanical strength of the closure when the lid is pushed open.

DESCRIPTION OF THE EXEMPLIFIED EMBODIMENT

Figure 1:
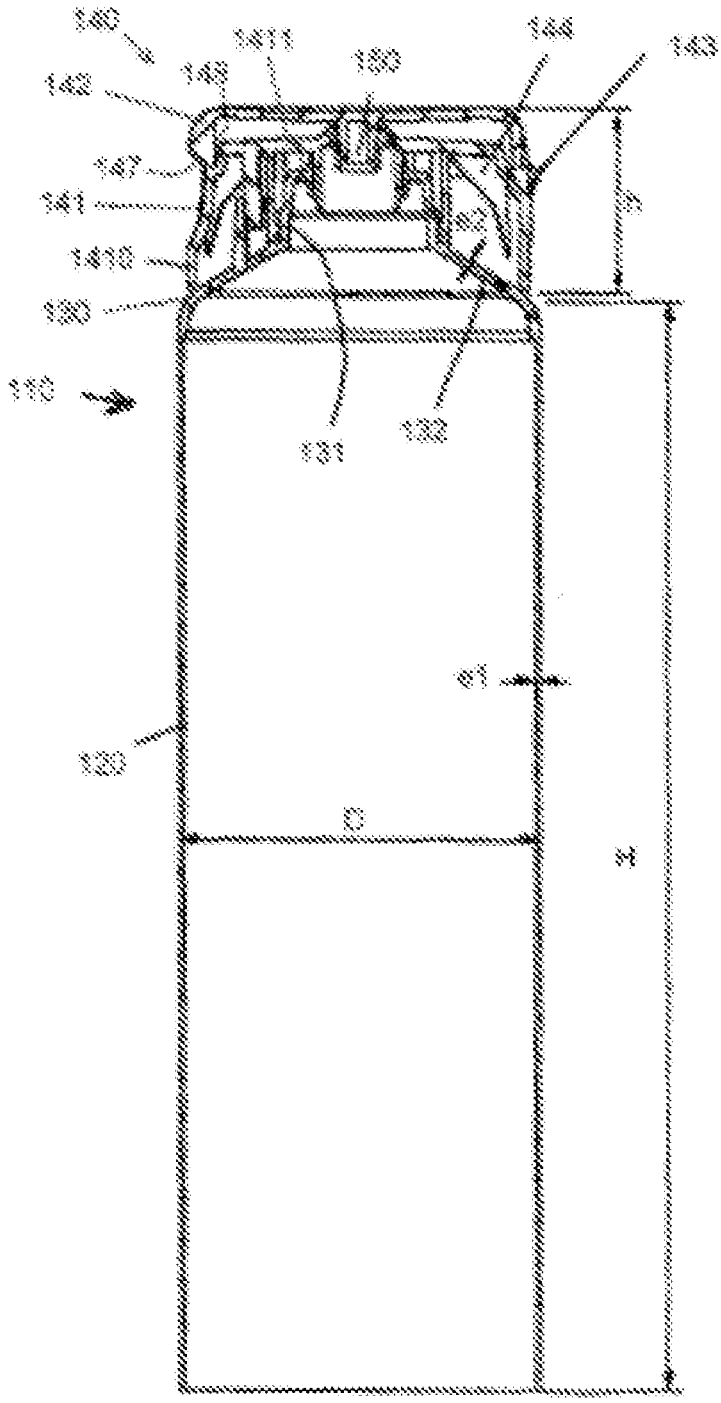
Fig. 1 (prior art)
FIG. 1 shows, in a diametral cross-section, a 150-ml tube of the prior art, equipped with a hinged-lid closure, intended for storing and dispensing shampoo.
Figure 2:
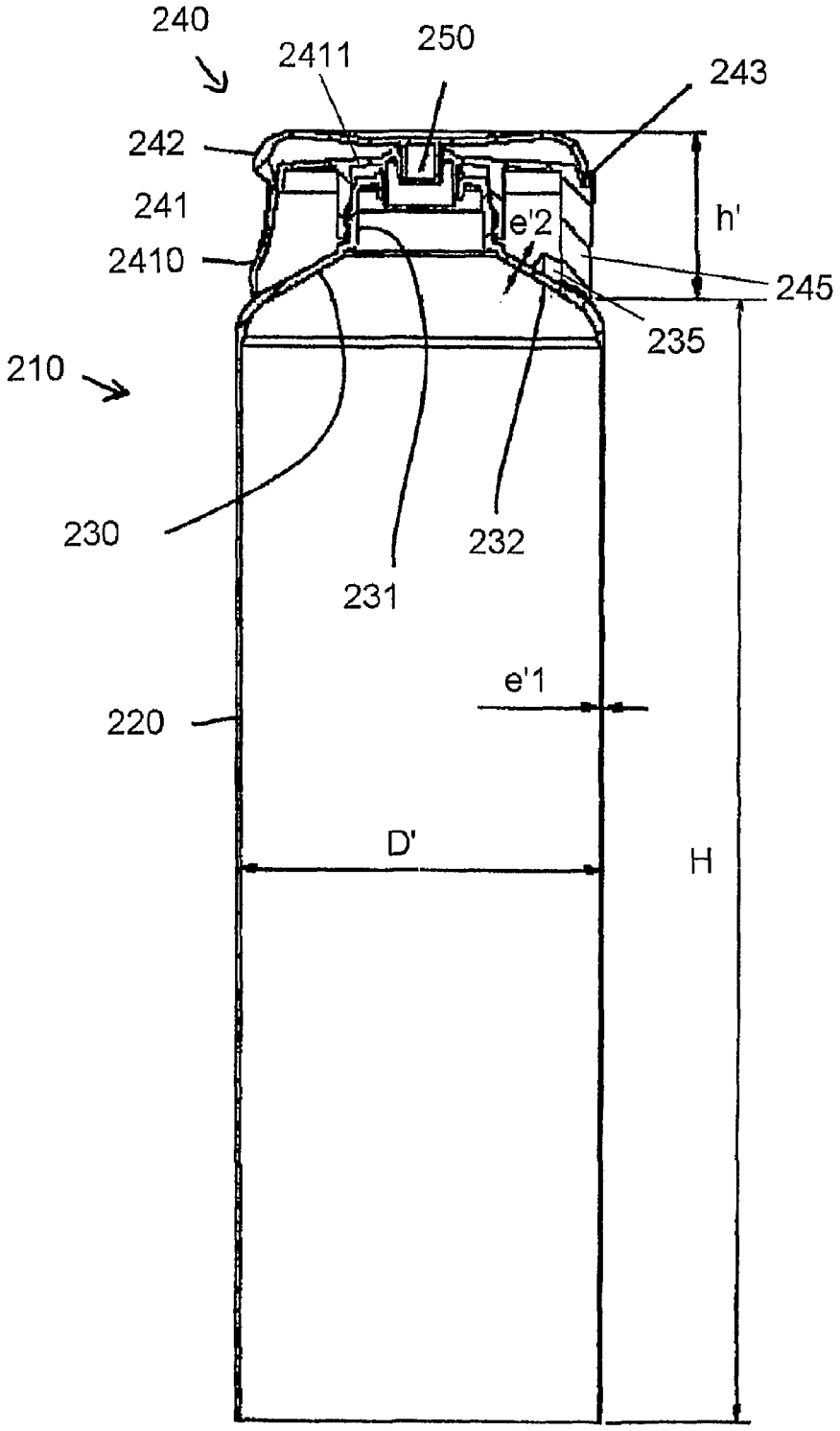
FIG. 2 shows, in a diametral cross-section, a tube according to the invention with the same capacity as that of FIG. 1, and intended for the same use.

The flexible tubes in this example have an effective volume of 150 ml for a shower gel that they are intended to contain. A tube of the prior art is shown in FIG. 1, and a specific tube according to the invention is shown in FIG. 2. This tube can be equipped with a hinged-lid closure as shown in FIG. 3 and moulded in an instrument of which a detail is shown in FIG. 4.

Figure 3:
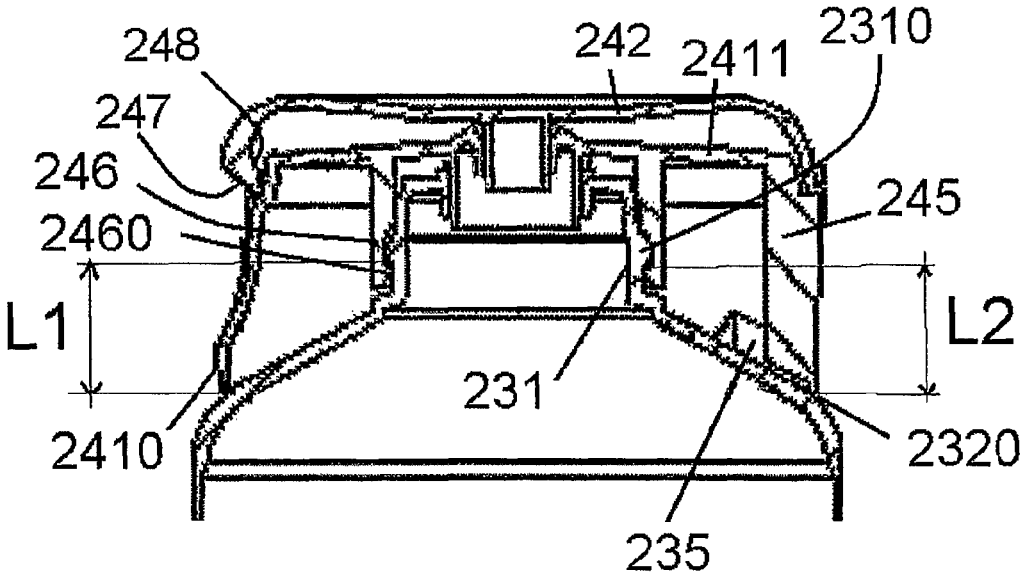
FIG. 3 shows, in a diametral cross-section, a detail of the tube of FIG. 2.
Figure 4:
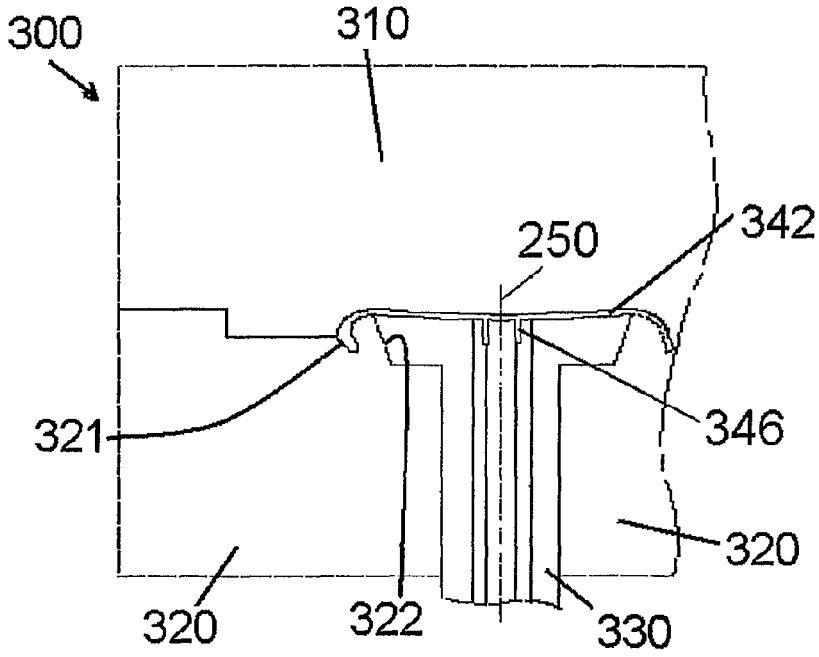
FIG. 4 shows, in a diametral cross-section, a detail of the moulding instrument for a lightweight hinged-lid closure according to the invention, located at the level of the lid.

Geometry and Weight Improvements (FIGS. 1, 2 and 3)

The tube 110 of the prior art has a diameter D of 50 mm and an overall height (greater than H+h) of around 175 mm. It has a skirt 120 and a dispensing head 130 equipped with a neck 131 and a shoulder 132 intended to connect said neck to said skirt. The skirt 120 is made of LDPE. It has a thickness e1 of 0.6 mm, which gives the shower gel-dispensing tube a certain rigidity. The head 130 is also made of LDPE. The shoulder 132 has a thickness e2 of 1.1 mm.

The weight of the tube according to the prior art is 16.4 g.

This tube is equipped with a hinged-lid closure 140 made of polypropylene, with a height h=25.2 mm. The hinged-lid closure 140 includes a base 141 intended to be irreversibly attached to the neck 131 of the tube and a lid 142 pivoting about a hinge 143 located at the periphery of the base and of the lid, the lid closing an aperture 150 formed in the base 141. The base 141 includes a plate 1411, equipped with the dispensing aperture and a cylindrical external lateral skirt 1410 configured so that it is located more or less in the extension of the skirt 120 of the tube. The hinged-lid closure 140 according to the prior art has a thick and rigid base. The rigidity is reinforced by the presence of 8 radial ribs 144, attached to the internal surface of the external lateral skirt 1410 and to the internal surface of the plate 1411. The lid 142 has, at the level of the upper portion 147 of the grip, a vertical wall 148.

The tube+hinged-lid closure assembly weighs 26 g.

The tube 210 according to the invention has a diameter D' of close to 50 mm and an overall height (H+h') of around 173 mm. It has a skirt 220 and a dispensing head 230 equipped with a neck 231 with a diameter of around 20 mm and a shoulder 232 intended to connect said neck to said skirt. The skirt 220 is made of HDPE. It has a thickness e'1 of 0.35 mm, which gives the shower gel-dispensing tube greater flexibility, which is satisfactory to all users.

The head 230 is also made of HDPE. The shoulder 232 has a thickness e'2 of 1 mm. The weight of this tube is 11 g. It is also possible to locally define lower thicknesses, on the order of 0.5 mm. The centering projections 235 are produced with a constant thickness, i.e. having a cavity near the inside of the tube.

This tube is equipped with a polypropylene hinged-lid closure 240, with a height h' equal to 22.7 mm. The hinged-lid closure 240 includes a base 241 intended to be irreversibly attached to the neck 231 of the tube and a lid 242 pivoting about a hinge 243 located at the periphery of the base and the lid, the lid closing an aperture 250 formed in the base 241. The lid 242 pivots about the hinge 243 when the user exerts a force in the upper portion 247 of the grip located on the lid. The base 241 includes a plate 2411, surrounded by a cylindrical external lateral skirt 2410, configured so that it is more or less in the extension of the skirt 220 of the tube. The hinged-lid closure 240 does not have 8 radial ribs for enhancing its rigidity, but only a single longitudinal rib 245, which is thin and of low radial height, attached to the internal surface of the external lateral skirt 2410. This longitudinal rib 245 makes it possible to index the hinged-lid closure with respect to the tube skirt, by trapping it between two projections of low breadth and low height, located on the shoulder 230. One of these projections is shown in FIG. 2 with reference 235. The lid 242 has, at the level of the upper portion 247 of the grip, a banked wall 248, inclined by around 25° with respect to the axis of the closure and oriented toward the inside of the base 241 of the closure 240. The axis of the closure is the axis of the attachment skirt 246. It coincides with the axis of the tube when the hinged-lid closure is attached to said tube.

The means for attaching the hinged-lid closure on the tube head are snap-on beads arranged, on the one hand, on an attachment skirt 246 attached to the plate 2411 and, on the other hand, on the neck 231 of the tube head.

The geometry of the external lateral skirt 241, in particular its height h', has been defined so that when the hinged-lid closure 240 is attached to the head of the tube, the open end of the external lateral skirt 2410 is near the shoulder 230 of the tube, typically at a distance d of less than 0.5 mm from the point 2320 of the shoulder located plumb over the axial extension of the external lateral skirt 2410. For this, the dimensional tolerance of the production imposed on the tube head and the hinged-lid closure are defined so that the minimum distance L1 between the end of the external lateral skirt 2410 and the contact point on the bead 2460 of the attachment skirt 246 is greater than L2−d, L2 being the maximum distance between the point of contact on the bead 2310 of the neck 231 and the point of the shoulder 2320. In this way, the end of the external lateral skirt of the base of the hinged-lid closure is immediately in local contact with the shoulder when the user handles the tube, and this gives the hinged-lid closure assembly an unexpected and sufficient rigidity in spite of the absence of ribs and the low thickness of the plate.

The tube+hinged-lid closure assembly weighs 16.7 g.

In addition, the attachment skirt 246 on the neck 231 has a thickness of 1.2 mm, which is greater than that of the rest of the hinged-lid closure, in particular the external lateral wall 2410 (0.9 mm). By applying, in the stripping process, an extractor exclusively at the open end thereof, it is possible to easily strip the entire closure, in spite of its thinned portions, and even though it is not supported by radial ribs. The attachment skirt 246 also has a non-continuous snap-on bead (in the form of regularly-distributed rice grains) cooperating with the snap-on bead 2310 of the neck 231.

It is thus noted that, with the invention, the weight of the dispensing tube has been reduced from 26 g to 16.7 g, i.e. an improvement of almost 36%.

Other tubes have been produced with skirts having a thickness of 0.35 mm and constituted by the following materials:

- entirely of HDPE
- a blend of HDPE 70% and LLDPE 30%
- a co-extruded skirt with the structure: HDPE (120 μm)/LLDPE (110 μm)/HDPE (120 μm)
- a co-extruded skirt with the structure: LLDPE (50 μm)/HDPE (240 μm)/LLDPE (60 μm)
- a co-extruded skirt with the structure: blend of HDPE 70%+LLDPE 30% (170 μm)/adhesive layer of EMA (10 μm)/EVOH (15 μm)/adhesive layer of EMA (10 μm)/blend of HDPE 70%+LLDPE 30% (170 μm) with EMA=methyl acrylate polymer and EVOH=copolymer (ethylene, vinyl alcohol).

The weight improvements are equivalent. The comfort of use is equivalent. But it is noted that the higher the LDPE content is, the poorer the machinability is.

Characterisation of the Mechanical Behaviour of the Skirts

Tests Enabling the Flexibility and Comfort of Use to be Estimated (Radial Deflection Forces)

The flexibility of the tube skirt is characterised by the value of an effort necessary to obtain a certain radial deflection after a certain time. The lower this value is, the more flexible the tube is. In addition, by comparing the values corresponding to two different radial deflections, it is possible to evaluate the comfort of use ("gripping") by noting the proportionality gap: if the value corresponding to a double radial deflection is greater than double the corresponding force, the tube opposes an increasing resistance to the users action. The greater the gap between these values, the more difficult the tube is to empty. Conversely, if the value corresponding to a double radial deflection is lower than double the corresponding force, the tube is emptied easily. The larger the gap between these values is, the more the tube has a tendency to suddenly collapse, which may surprise the user with a greater discharging flow of product than expected.

The flexibility can be measured with standardized bending tests using the bearing plate method: one half of the skirt is cut along a diametral plane, then fitted by its ends on a support. The apex of the arch thus formed is compressed using an axial device that comes into contact with the generatrix of the apex of the arch. The value of the deflection force corresponding to two given deflections is measured: for example, 5 mm and 10 mm.

The following table shows the values of the forces (in N) relating to the two deflections for skirts with a diameter 50 having the structures described above:

| Reference | Material | Thickness | Radial deflection = 5 mm | Radial deflection = 10 mm |
|---|---|---|---|---|
| Tube A | 100% LDPE | 565 μm | 6.1 N | 17.2 N |
| Tube B | 100% HDPE | 340 μm | 3.6 N | 9.8 N |
| Tube C | 90% HDPE 10% LLDPE | 340 μm | 3.5 N | 9.4 N |
| Tube D | 70% HDPE 30% LLDPE | 350 μm | 3.1 N | 8.2 N |

It is noted, on the one hand, that the skirts of tubes B to D according to the invention are more flexible than the skirts of the prior art (Tube A), and, on the other hand, that the proportionality gap is on the same order of amplitude (ratios between forces between 2.6 and 2.8 for a double deflection): the tubes according to the invention are more flexible that that of the prior art, while having an identical comfort of use.

Test for Assessing Machinability

The machinability of the tube is characterised by the ability of the skirt to resist an axial deflection force.

The skirt is cut to a given length (80 mm in this case), one of the free ends of the sleeve thus obtained is compressed, and a force is applied to the other free end, which force is distributed over the entire circumference, by means of a plate that moves downwardly at a constant rate in the axial direction of the sleeve. The value of the deflection peak is measured just before folding or buckling of the sleeve.

The following table shows the value of the maximum forces (in N) obtained with the previous types of skirt (diameter 50 mm).

| Reference | Material | Thickness | Peak |
|---|---|---|---|
| Tube A | 100% LDPE | 585 μm | 179 N |
| Tube B | 100% HDPE | 355 μm | 249 N |
| Tube C | 90% HDPE 10% LLDPE | 340 μm | 230 N |
| Tube D | 70% HDPE 30% LLDPE | 370 μm | 187 N |

These results show that tube B, of which the skirt is made entirely of HDPE has, in spite of its low thickness, a better aptitude for machinability than the tube of the prior art. The tubes having skirts with a mixture of LDPE and HDPE also have a good aptitude, the mixture of 70% HDPE and 30% LLDPE having a behaviour comparable to that of the tube of the prior art.

Tests for Assessing the "Dead Fold" Property

| Sample reference | Angle after spring back (°) |
|---|---|
| 100% LD, thickness 0.5 | 128 +/− 8 |
| 100% HD, thickness 0.35 | 61 +/− 4 |
| Blend 70% HDPE + 30% LLDPE, thickness 0.35 | 83 +/− 3 |

It is noted that a LDPE tube with a thickness of 0.5 has good memory. It returns to 128° (for complete memory, the angle after resilient return would be 180°), while for the HDPE tube with a thickness of 0.35, the angle after resilient return is equal to only 61°. It is thus similar to the behaviour of the flexible metallic tube.

Illustration of the Weight Improvement for Truck Loads

A standard truck (not low-slung) can transport 66 pallets of tubes with a diameter of 50 mm (capacity 150 ml), i.e. around 140,000 tubes.

With an improvement of 9.3 g per tube, we gain around 1.3 tons. In addition to the improvement associated with enhanced strength of the tubes of the lower pallets, the truck transports a significantly lower load and therefore saves energy, which, moreover, makes it possible to reduce the emission of carbon dioxide in the atmosphere.

Stripping of a Lightweight Hinged-Lid Closure Having a Back Draft Portion at the Level of the Grip (FIG. 4)

FIG. 4 shows, in a diametral cross-section, a detail of the moulding instrument 300 of a lightweight hinged-lid closure according to the invention, such as the closure 340. The instrument has a plurality of parts: an upper part 310, a lower part 320 equipped with an extractor 330. The pivoting lid of the hinged-lid closure is produced by moulding in the cavity 342. The lower part 320 of the mould includes a wall 321 that delimits the upper part 2421 (external) of the grip and a wall 322 located on the other side of the wall 321 and oriented toward the inside of the lid. In the prior art, the wall 322 was vertical, which had the advantage of facilitating the stripping process and the disadvantage of significantly increasing the thickness and therefore the heaviness of the lid. The applicant found that it was nevertheless possible to produce a wall 322 with a back draft having a slope of less than 35° without having any difficulty in the stripping process with a standard mould, i.e. without a drawer or a mounting plate, but using an extractor 330 acting on the centre of the lid. Thus moulded, the lid has, opposite the upper portion 247 of the grip, an inclined wall—with an angle of less than 35° with respect to the axis of the hinged-lid closure—toward the inside of the base of the closure. The axis of the hinged-lid closure is the axis 250 of the attachment skirt, the cavity of which is designated by reference 346. It coincides with the axis of the tube when the hinged-lid closure is attached to said tube.

ADVANTAGES

Reduction in the energy required for forming the tubes, and the welding and recycling thereof;

Good stress-cracking resistance;

Improved barrier to liquids and odours.

The invention claimed is:

1. Hinged-lid closure comprising a lid, a base including a plate, an attachment skirt and an external lateral skirt, and a hinge attaching the lid to the base, wherein the attachment skirt is thicker than the plate and the external lateral skirt, and wherein the base comprises a single radial longitudinal rib projecting radially from an inner surface of the external lateral skirt at a mid-point of and perpendicular to the hinge, the rib improving mechanical strength of the closure with the lid in an open position, and having a thickness limited to enable the rib to be retained between radial projections on a shoulder of a tube to which the closure is adapted to be attached.

2. Hinged-lid closure according to claim 1, wherein the lid has a grip and an internal wall opposite an upper portion of the grip inclined by an angle smaller than 35° with respect to an axis of the hinged-lid closure and oriented toward inside the base of the hinged-lid closure.

3. Hinged-lid closure according to claim 1, wherein the attachment skirt is thicker than the plate and the external lateral skirt by less than a millimeter.

4. Assembly comprising the tube and the hinged lid closure according to claim 1.

5. Assembly according to claim 4, wherein the hinged-lid closure and the shoulder of the tube comprise an indexing means, the hinged-lid closure having the longitudinal rib attached to the inner surface of the external lateral skirt, the shoulder having two projections of low breadth and low height and angularly spaced, the longitudinal rib being trapped in a space separating the two projections.

6. Assembly according to claim 5, wherein the shoulder of the tube has projections of constant thickness, said projections being oriented toward outside the tube and having a cavity toward inside the tube.

7. Assembly according to claim 4, wherein the tube has a diameter of greater than 55 mm; and wherein the tube has a weight of less than 1.1 g per centiliter of effective volume provided for the product that the tube is intended to store and dispense.

8. Assembly according to claim 4, wherein the tube comprises a dispensing head and a tube skirt comprising a plastic or metalloplastic material, with a diameter greater than 44 mm, the tube skirt having a thickness of between 0.2 mm and 0.4 mm, and comprising high-density polyethylene (HDPE) with a specific weight of between 0.935 g/cm$^3$ and 0.97 g/cm$^3$, in a weight proportion greater than 55%.

9. Assembly according to claim 8, wherein the open end of an tube skirt is at an average distance from the shoulder of the tube.

10. Assembly according to claim 9, wherein the shoulder of the tube is equipped with a path around which the open end of the tube skirt fits with an average radial clearance of less than 0.5 mm.

11. Assembly according to claim 9, wherein the average distance is between 0.2 mm and 0.5 mm.

12. Assembly according to claim 10, wherein the average radial clearance is less than 0.3 mm.

13. Assembly according to claim 4, wherein the tube is a flexible tube.

14. Hinged-lid closure according to claim 1, wherein the tube to which the closure is adapted to be attached is a flexible tube.

15. Assembly according to claim 4, wherein the tube skirt is a cylindrical tube skirt.

* * * * *